US008950031B1

(12) United States Patent
Jaramillo

(10) Patent No.: US 8,950,031 B1
(45) Date of Patent: Feb. 10, 2015

(54) STEAMING DEVICE AND STEAMING METHOD

(76) Inventor: Vincent I. Jaramillo, Newport Beach, CA (US)

( * ) Notice: Subject to any disclaimer, the term of this patent is extended or adjusted under 35 U.S.C. 154(b) by 1109 days.

(21) Appl. No.: 12/955,378

(22) Filed: Nov. 29, 2010

Related U.S. Application Data

(60) Provisional application No. 61/283,179, filed on Nov. 30, 2009.

(51) Int. Cl.
*D06F 73/00* (2006.01)
*D06F 87/00* (2006.01)

(52) U.S. Cl.
CPC ..... *D06F 87/00* (2013.01)
USPC ..... 8/149.3; 68/5 R; 68/5 C; 68/6; 134/175

(58) Field of Classification Search
CPC ..... D06F 87/00; D06F 39/008; D06F 73/00
USPC ..... 68/5 C, 13 R, 3 R, 222, 6, 5 R, 240; 8/149.3, 149.1, 149.2, 158; 134/137, 134/153, 22.1; 206/287, 289; 34/622, 202, 34/218; 248/214
See application file for complete search history.

(56) References Cited

U.S. PATENT DOCUMENTS

| | | | | |
|---|---|---|---|---|
| 3,712,086 | A * | 1/1973 | Payet et al. | 68/5 C |
| 3,752,373 | A | 8/1973 | Smith | |
| 4,728,015 | A | 3/1988 | Holzapfel et al. | |
| 4,894,935 | A | 1/1990 | Kretz | |
| 5,687,278 | A | 11/1997 | Turner | |
| 5,730,006 | A | 3/1998 | Conley | |
| 2004/0055186 | A1 * | 3/2004 | Bolduan et al. | 38/144 |
| 2008/0155757 | A1 * | 7/2008 | Kim et al. | 8/149.3 |
| 2009/0065536 | A1 * | 3/2009 | Moon et al. | 223/70 |

FOREIGN PATENT DOCUMENTS

| | | | | |
|---|---|---|---|---|
| DE | 3600953 A1 * | 7/1987 | | D06B 5/24 |
| WO | WO 2009020305 A2 * | 2/2009 | | D06F 58/10 |
| WO | PCT/US2011/023999 | 12/2011 | | |

OTHER PUBLICATIONS

English Machine Translation of Description of DE3600953 A1 (Hloch et al. 1987).*
Intl. Search Report and Written Opinion.

* cited by examiner

*Primary Examiner* — Michael Barr
*Assistant Examiner* — Irina Graf
(74) *Attorney, Agent, or Firm* — John J. Connors; Connors & Assoc. pc

(57) ABSTRACT

A garment hung in a vertical orientation has at least one entire side of the garment exposed to steam from a steaming device including a planar steam panel having a steam emitting side with a surface area including restricted orifices distributed substantially uniformly over the steam emitting side. Jets of steam shoot under pressure from the surface area of the steam panel, this surface area being essentially the same as or greater than the area of the one entire side of the garment being treated. The hanging garment is placed next to the steam panel with the steam emitting side positioned to direct the steam jets from the orifices towards the garment so that essentially the one entire side of the garment is treated simultaneously as steam impinges against the entire area of this one side of the garment.

1 Claim, 15 Drawing Sheets

STEAMING DEVICE AND STEAMING METHOD

RELATED PATENT APPLICATIONS & INCORPORATION BY REFERENCE

This utility application claims the benefit under 35 USC 119(e) of U.S. Provisional Patent Application No. 61/283,179, entitled "Steam Panel/Device for Steaming Garments and other objects," filed Nov. 30, 2009. This related application is incorporated herein by reference and made a part of this application. If any conflict arises between the disclosure of the invention in this utility application and that in the related provisional application, the disclosure in this utility application shall govern. Moreover, any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The word "garment" includes any object that may benefit from applying steam to it, especially those objects made of fabric that may be wrinkled, soiled, or both.

The word "rectangular" includes square.

The words "substantially" and "essentially" have equivalent meanings

BACKGROUND

Steaming of garments is a well-known technique for removing wrinkles and soil and providing other benefits. My steaming device and steaming method are intended to provide a more convenient way of steam treating garments.

SUMMARY

My steaming device and steaming method have one or more of the features depicted in the embodiments discussed in the section entitled "DETAILED DESCRIPTION OF SOME ILLUSTRATIVE EMBODIMENTS." The claims that follow define my steaming device and steaming method, distinguishing them from the prior art; however, without limiting the scope of my steaming device and steaming method as expressed by these claims, in general terms, some, but not necessarily all, of their features are:

One, my steaming device includes a steam panel and a steam generator, which may be affixed to the panel or it may be a portable unit that is attached and detached to the panel as desired.

Two, the panel has in at least one side a plurality of orifices that are in communication with an internal steam compartment within the panel. The panel may have a second side opposed to the one side and at least some of the orifices are in this second side. The orifices are distributed over their corresponding side of the panel so that a wall of steam substantially corresponding in area to that of this side is propelled from the panel to engulf a garment adjacent this side of the panel. Jets of steam shoot from the orifices substantially at a right angle from their corresponding side of the panel. These jets, and their corresponding orifices, are substantially uniformly distributed over the side from which they are being propelled. Normally, the individual diameters of the orifices are less than approximately ¼ inch.

Three, the internal steam compartment is in communication with the steam generator to enable steam from the generator to flow under pressure into the compartment. The internal steaming compartment may include a plurality of narrow passageways extending substantially the entire length of the panel and at least some of the orifices are spaced apart along the passageways. Or, the internal steaming compartment may comprise a single steam chamber within the panel corresponding substantially in volume to the entire volume of the panel. The panel may be substantially rectangular having a length substantially from 24 to 60 inches, a width substantially from 12 to 36 inches, and the depth substantially from ⅛ to ½ inch.

Four, a hanger member is connected to the panel that enables the panel to be hung by the hanger member in a substantially vertically orientation. A hook of the hanger member may swivel to reverse the sides of the panel. The hanger member may be at a top or upper end, enabling the panel to be hung by the hanger member in a substantially vertically orientation. The steam generator may be at an opposite or bottom lower end. The panel may be planar. In one embodiment, the passageways are spaced apart and extend substantially vertically when the panel is hung in a substantially vertically orientation. The passageways may have a cross-sectional area substantially from ⅛ to ½ square inch that is substantially uniform along essentially the entire length of the passageway. At least a substantial portion of the passageways may be substantially parallel to each other. The passageways may each have an individual terminal in communication with the steam generator, or at least some of the passageways may converge near the bottom lower end of the panel to form a single port for connection to the steam generator. In one embodiment, the panel is fixedly attached to a vertical sidewall of a closet, and the panel is stationary and the side with the orifices therein faces inward toward an interior of the closet.

My method of treating a garment with steam comprises hanging vertically my device next to the garment that is in a vertical orientation to expose simultaneously at least one entire side of the garment to the jets of steam shooting under pressure from my device. The surface area of the steam panel is essentially the same as or greater than the area of the one entire side of the garment being treated. The panel is positioned relative to the side of the garment being treated so the steam emitted from the one side of the panel is directed by the orifices towards the garment. Thus, essentially the one entire side of the garment is treated simultaneously as steam impinges against the entire area of the one side of the garment. The distance between the garment and the steam panel is less than approximately 18 inches.

These features are not listed in any rank order nor is this list intended to be exhaustive.

DESCRIPTION OF THE DRAWING

Some embodiments of my steaming device and method are discussed in detail in connection with the accompanying drawing, which is for illustrative purposes only. This drawing includes the following figures (FIGS.), with like numerals indicating like parts.

DETAILED DESCRIPTION OF SOME ILLUSTRATIVE EMBODIMENTS

Figure 1:
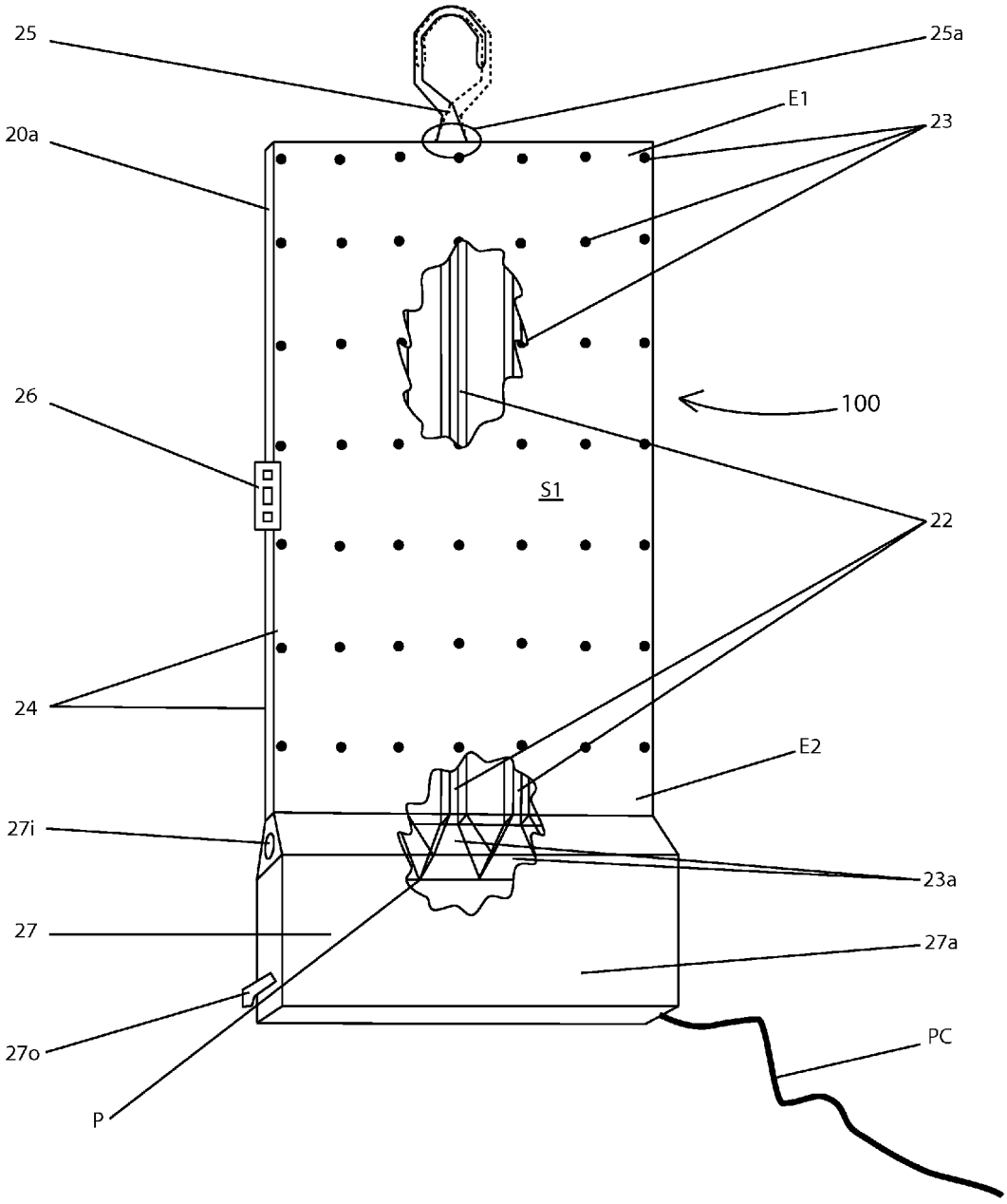
FIG. 1 is a perspective view, with sections broken away, of one embodiment of my steaming device.

I have developed a steaming device that sprays steam onto the exterior of essentially one entire side of a garment for the purpose of removing wrinkles from it, or cleaning it, or for any other reason applying steam may be beneficial. There may be several different embodiments of my steaming device, all of which employ a planar steam panel generally designated by the numeral 20 in the embodiments of my steaming method depicted in FIGS. 11 through 13. All the embodiments of the steam panel have at least one side from which shoot jets of steam that are substantially uniformly distributed over this one side and are substantially at a right angle to this one side. These example embodiments are: The embodiment depicted in FIGS. 1 through 4 and designated by the numeral 100 that uses a panel including a plurality of passageways 22. The embodiment depicted in FIGS. 5 and 6 and designated by the numeral 300 that uses a panel 20*c* with an open wall so steam emitted from one side of the panel can flow through the open wall to an opposed side of the panel. The embodiment depicted in FIGS. 7 and 8 and designated by the numeral 400 that uses a panel 20*d* similar to that depicted in FIGS. 5 and 6, except it has a closed wall that prevents the flow of steam to the opposed side of the panel. The embodiment depicted in FIGS. 9 and 10 and designated by the numeral 500 that uses a panel 20*e* with a single steam chamber 500*a* (FIG. 10). The embodiment depicted in FIG. 10A and designated by the numeral 600 that uses a panel 20*f* having a plurality of passageways 22 that converge at bottom or lower ends 22*a* at a terminal T for connection to a portable steam generator 29. The embodiment depicted in FIG. 10B and designated by the numeral 700 is a stationary unit built into a closet and may be used in conjunction with another embodiment of my steaming device 800, which optionally may be used with my steaming device 700.

FIGS. 1 through 4

Figure 2:
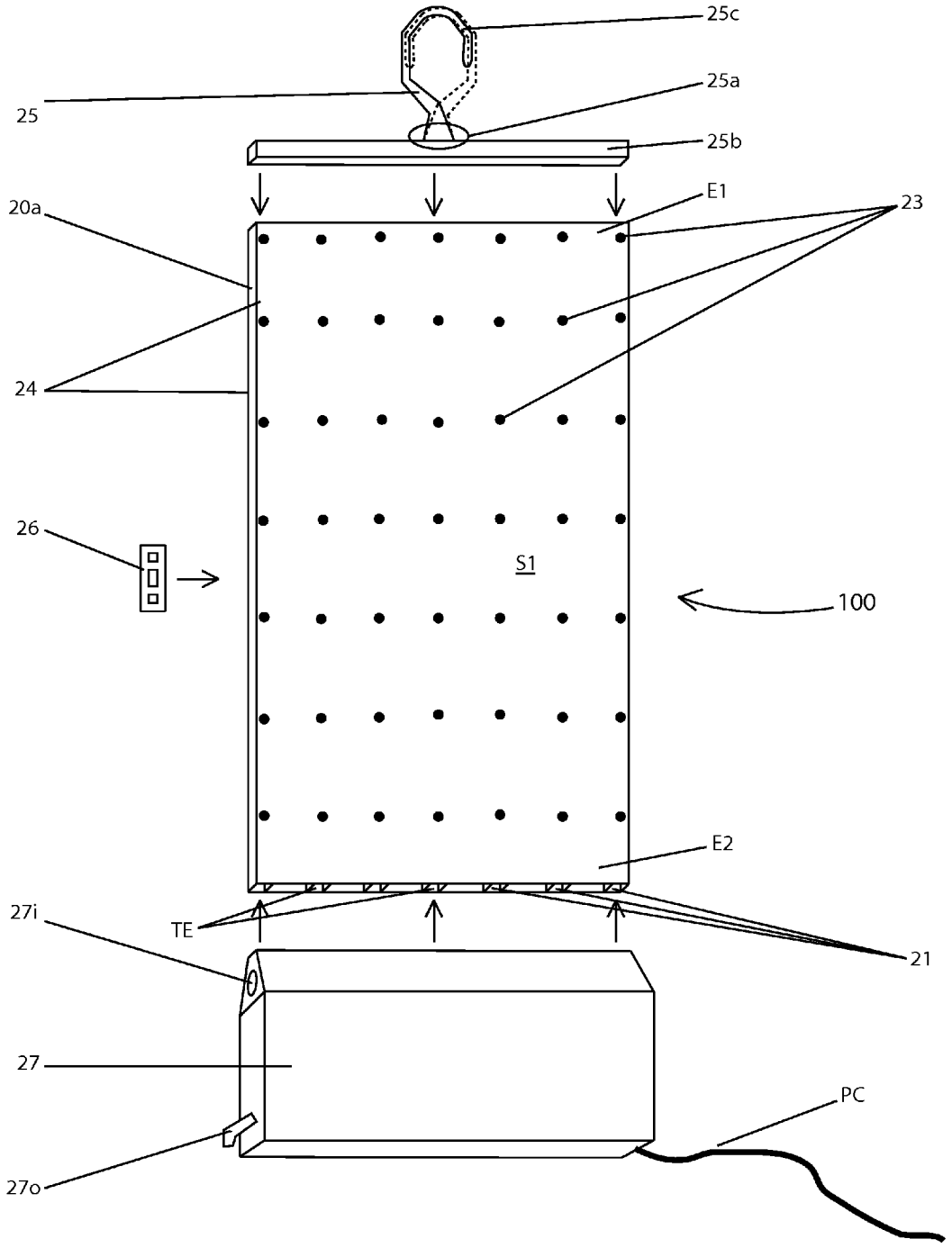
FIG. 2 is an exploded perspective view of the embodiment of my steaming device shown in FIG. 1.
Figure 3:
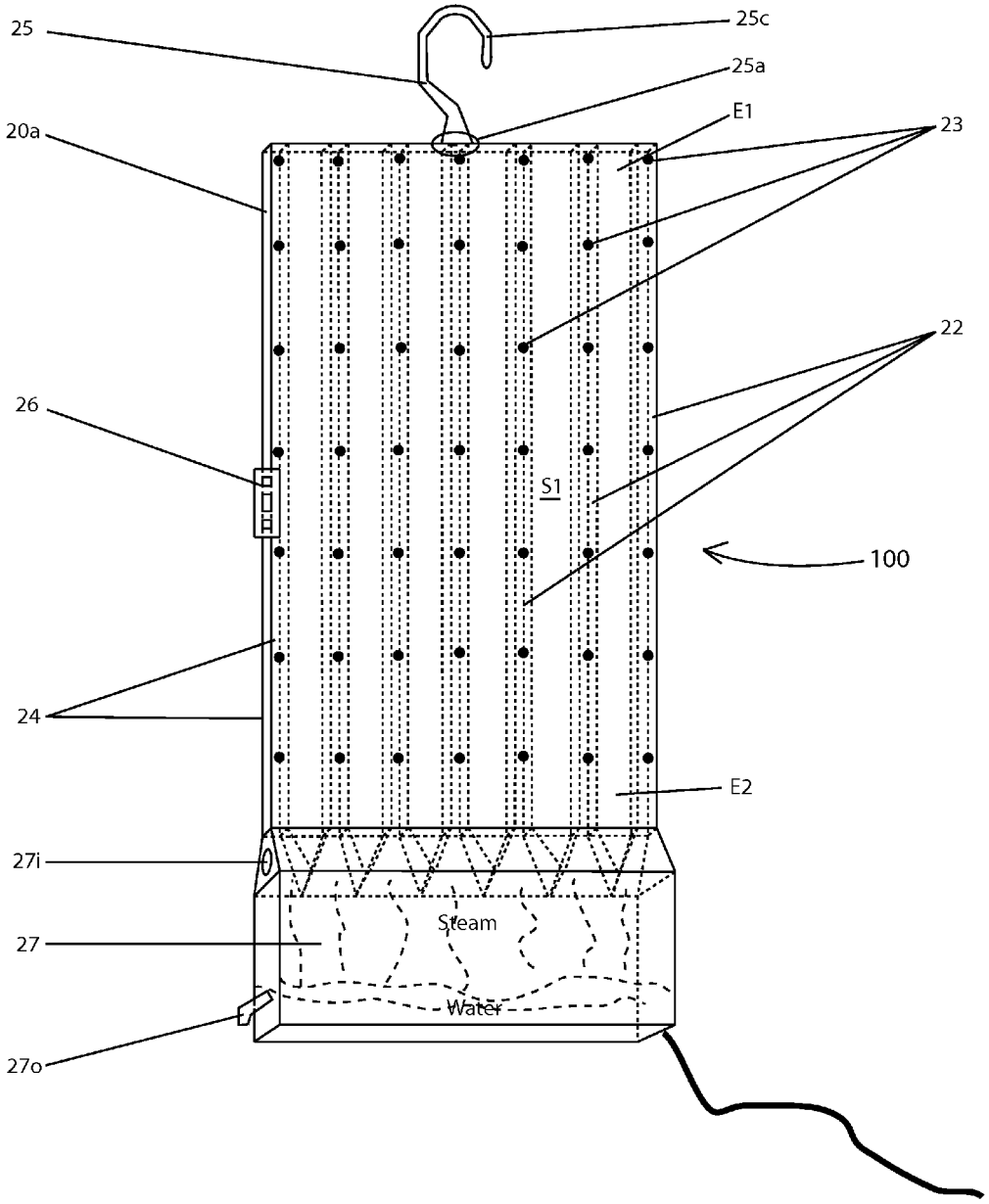
FIG. 3 is a perspective view of the embodiment of my steaming device shown in FIG. 1 with the internal mechanical structure shown in outline.
Figure 4:
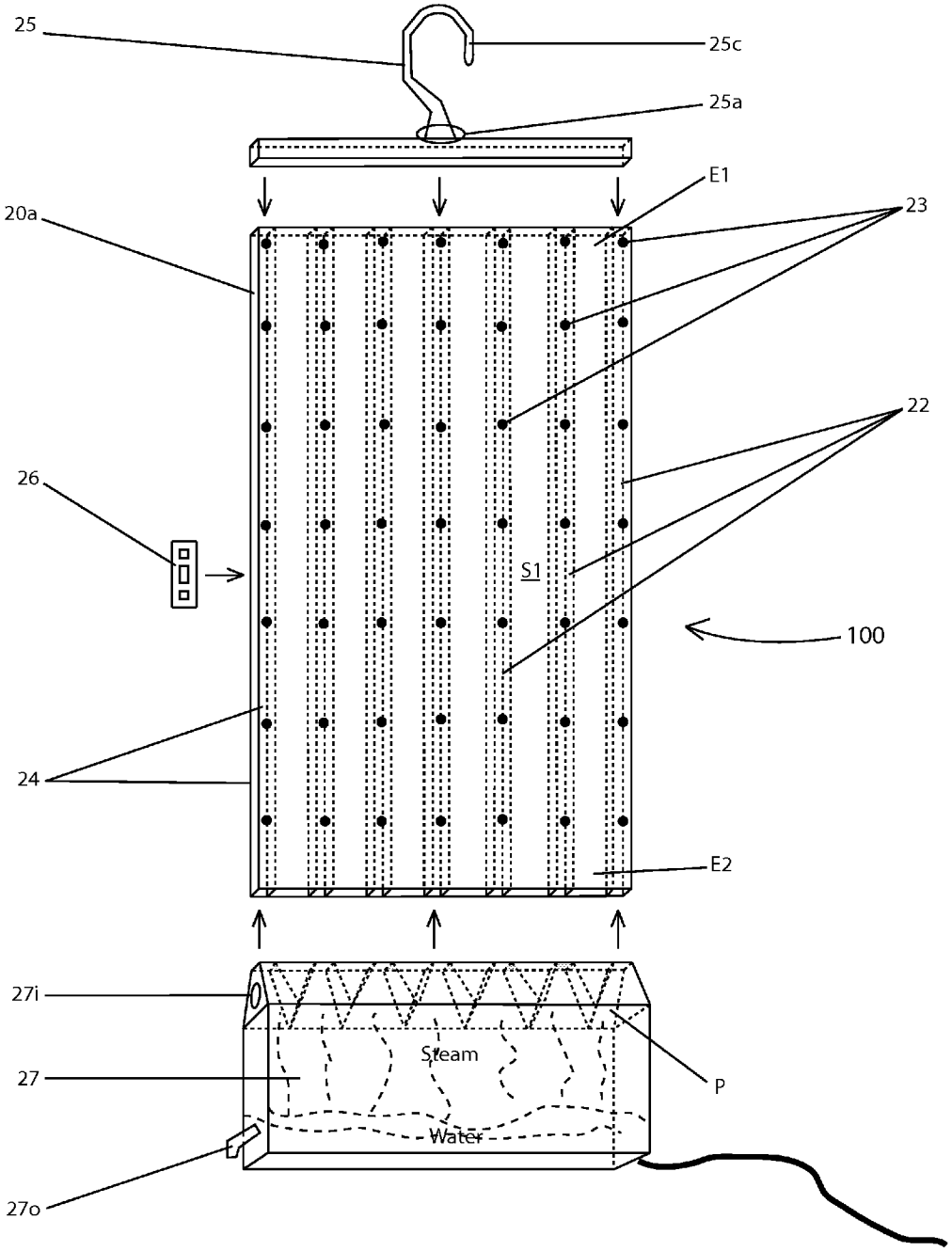
FIG. 4 is an exploded perspective view of the embodiment of my steaming device shown in FIG. 3.

FIGS. 1 through 4 illustrate my steaming device 100 made from a steam resistant material. It includes a planar, thin, substantially rectangular steam panel 20*a* including hollow, parallel steam passageways 22, together forming an internal steam chamber. The passageways 22 are narrow and restricted and extend substantially the entire length of the panel. The passageways 22 each have a cross-sectional area substantially from ⅛ to ½ square inch and this cross-sectional area is substantially uniform along essentially the entire length of individual passageways. Each passageway 22 has a separate open terminal end TE (FIG. 2).

The panel 20*a* has a pair of opposed sides, only one side S1 being shown. These opposed sides are of the same shape and dimensions, and in this embodiment are both rectangular. A pair of opposed solid sidewalls 24 connect the opposed sides together. In the one side S1 of the panel 20*a* are a plurality of steam exit holes or orifices 23 that are in communication with the passageways 22. The orifices 23 have a restricted diameter of less than approximately ¼ inch. The solid sidewalls 24 block the steam from escaping at the edges during the steaming, but are not absolutely necessary for proper functioning of the panel.

Figure 11:
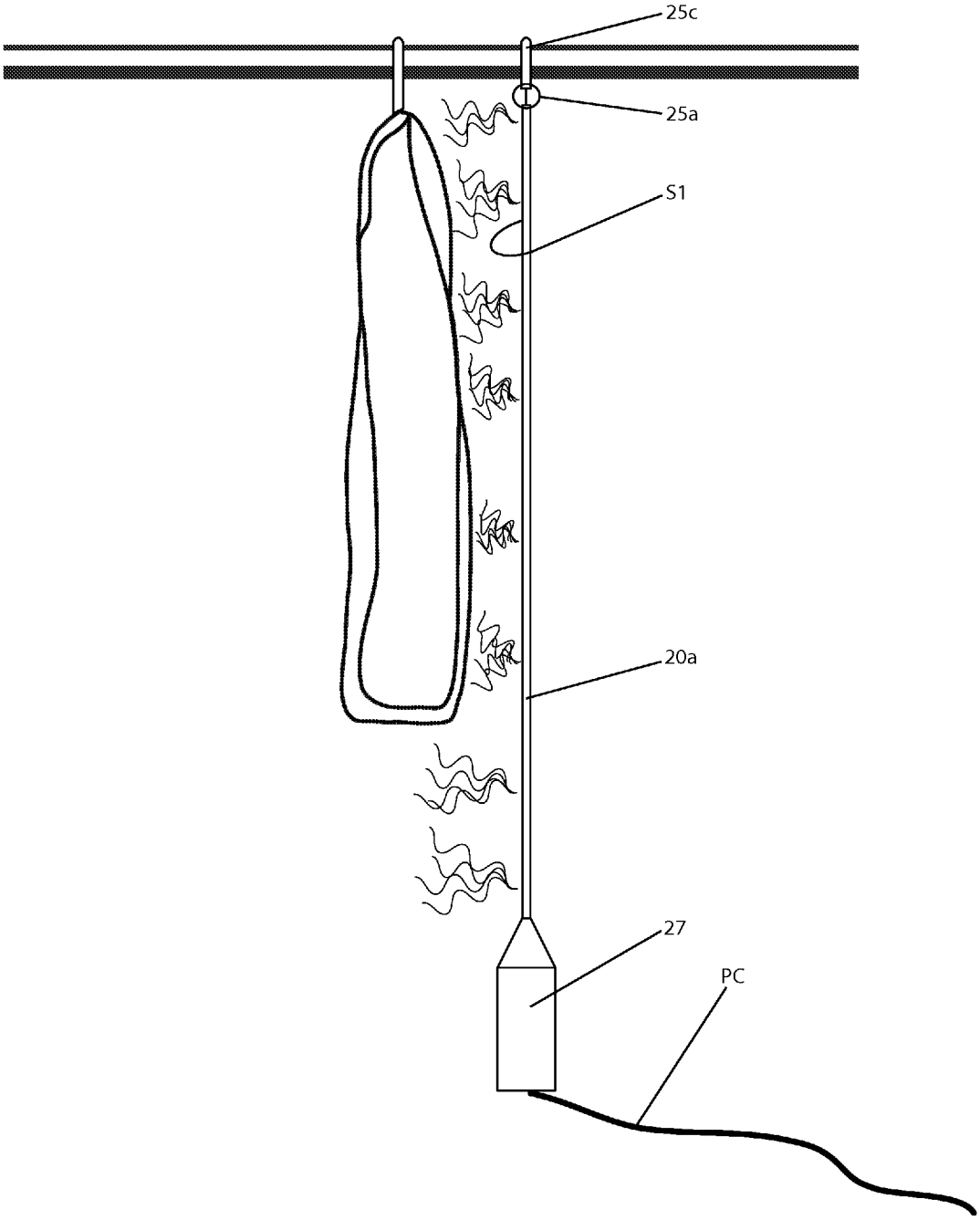
FIG. 11 is a side view of an embodiment of my steaming device comprising a single one-sided steam panel steaming one side of a single garment.
Figure 12:
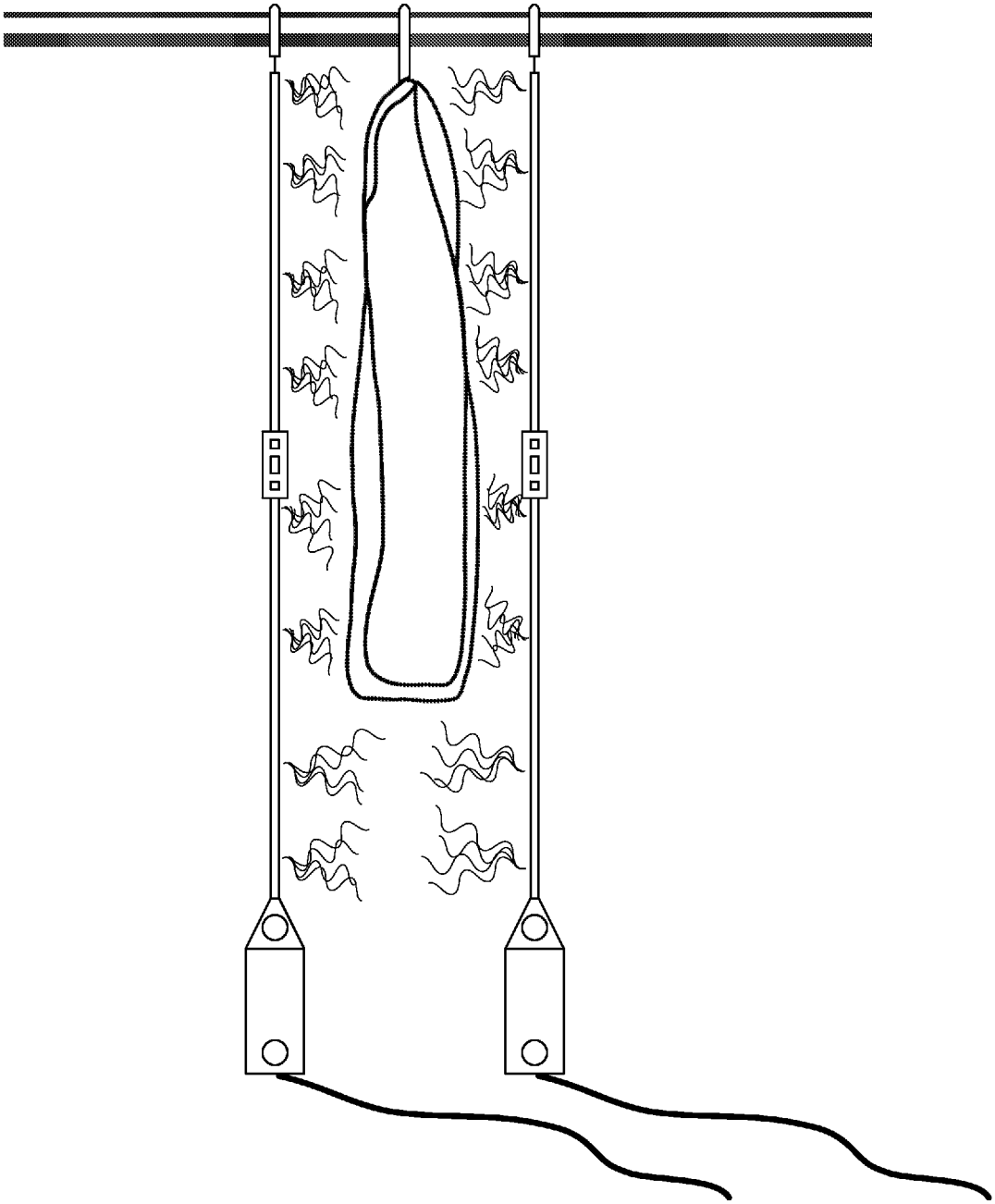
FIG. 12 is a side view of a pair of my steaming devices, each comprising a one-sided steam panel.
Figure 13:
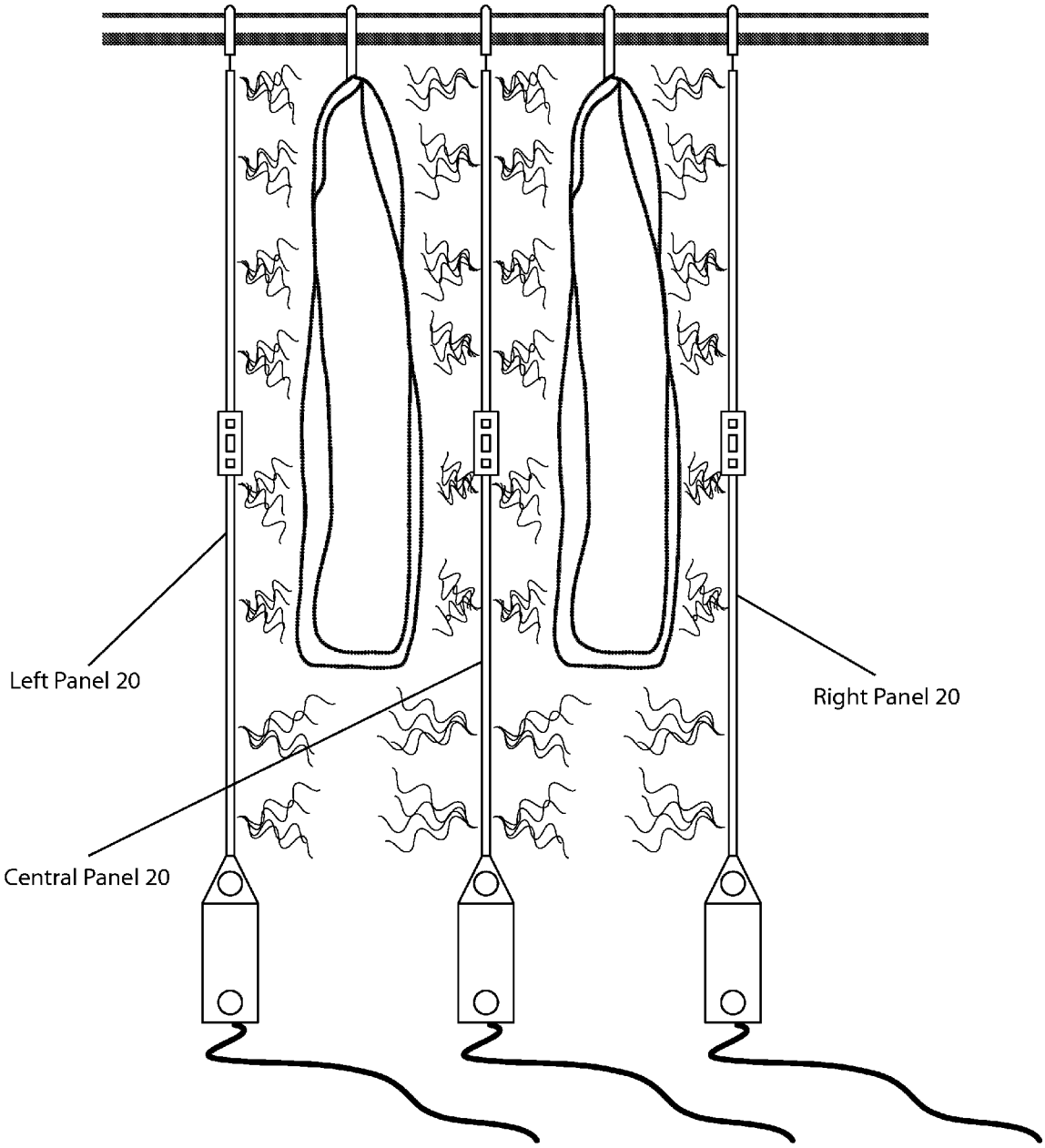
FIG. 13 is a side view of a pair of garments being steam treated using concurrently two different embodiments of my steaming device.

At one end E1 is a hanger member 25 enabling a panel to be hung by the hanger member in a substantially vertically orientation as shown in FIGS. 11 through 13. At an opposite end E2 of a panel, in this embodiment the panel 20*a*, is a steam generator 27 fixedly attached to the bottom or lower end E2 of the panel. The steam generator 27 has an inlet 27*i* and an outlet 27*o* that allows an internal reservoir 27*a* (FIG. 1) to be filled or drain as needed. The individual steam passageways 22 forming the steam chamber are in communication with the steam generator 27 at their terminal ends TE (FIG. 2) to enable steam from the generator to flow under pressure into the passageways and out the orifices 23. The orifices 23 are distributed substantially uniformly over the one side S1 of the panel 20*a*. Consequently, when treating a garment, a wall of steam substantially corresponding in area to that of the one side S1 of the panel is propelled from the panel to impinge against the surface of a garment adjacent the one side S1 and engulf the garment in steam.

Another embodiment of my steaming device includes a panel like that of the panel 20*a* except its opposed second side also includes a plurality of orifices therein. These orifices in the opposed second side are in communication with the passageways 22. Such orifices are also distributed substantially uniformly over this opposed second side of the panel. For example as illustrated in FIG. 13, a central panel 20 has orifices 23 in both panel sides. Thus, a wall of steam substantially corresponding in area to that of the second side of the central panel 20 is propelled from the panel to impinge against the surface of a second garment adjacent the opposed second side and engulf the second garment in steam.

The hanger member 25 may include a support crossbar 25*b* and a swivel connector 25*a* that attaches a hook 25*c* to the crossbar. This enables the panel 20*a* to reverse sides. Since panel 20*a* only has orifices 23 on the side S1, rotating the hook 25*c* 180 degrees about the swivel connector 25*a* moves the hook to the dotted line position shown in FIG. 2. This switches the side S1 from a right hand position to a left hand position as depicted in FIG. 11 The panel 20*a* is therefore reversible.

The passageways 22 each have an individual terminal end TE in communication with the steam generator 27. The passageways 22 at the terminal ends TE terminate at funnel structures 23*a* that project outward from a partition P (FIG. 1) in the reservoir 27*a* of the steam generator 27. Thus steam under pressure flows directly into the terminal ends TE of the passageways 22 when water in the steam generator 27 boils. An on/off/timer switch 26 may be used to start and stop steam generator 23. When the switch 26 is closed, electrical energy is provided by a power cord PC to a heating element (not shown) in the reservoir 27*a*.

Figure 5:
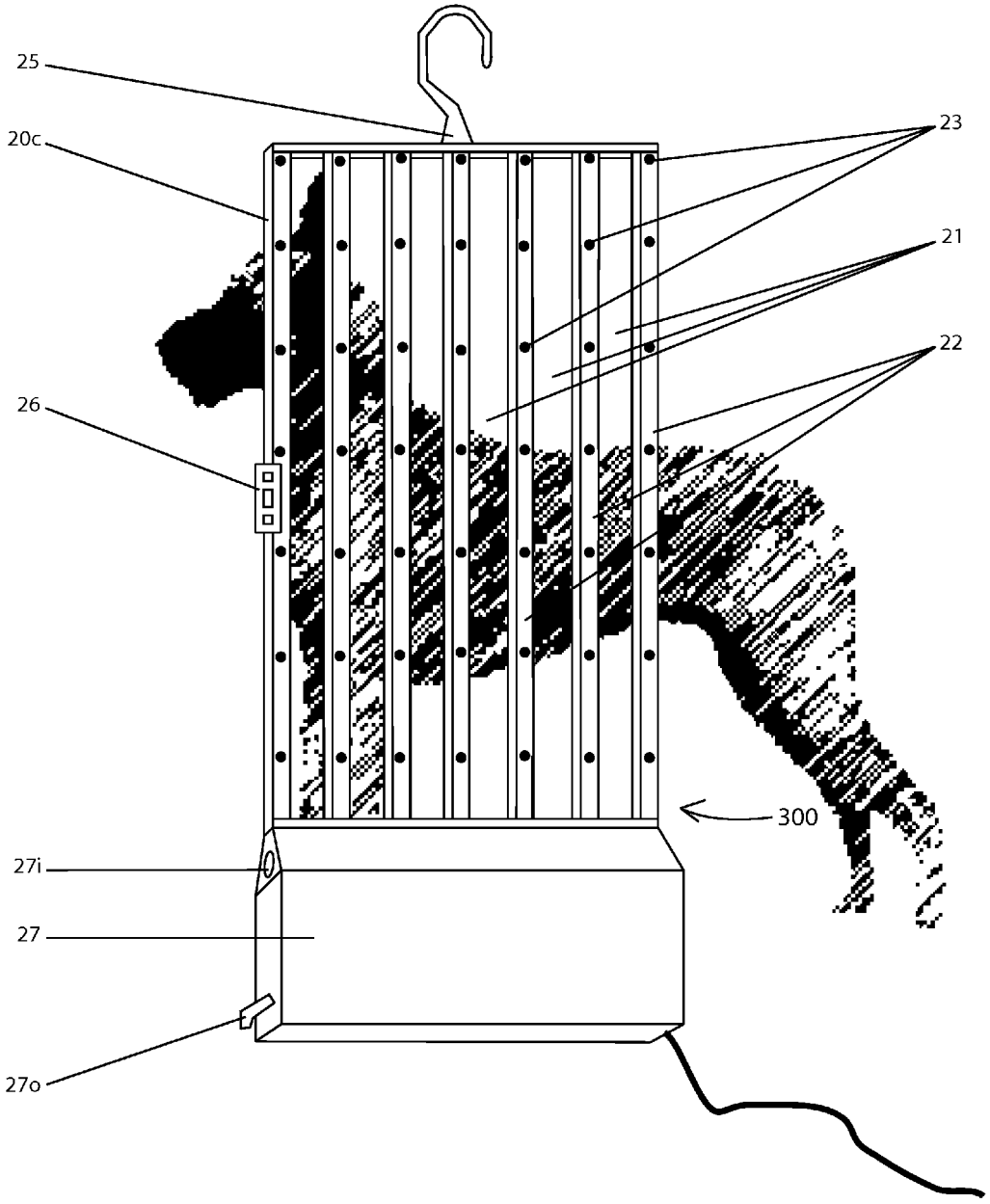
FIG. 5 is a perspective view of a third embodiment of my steaming device.
Figure 6:
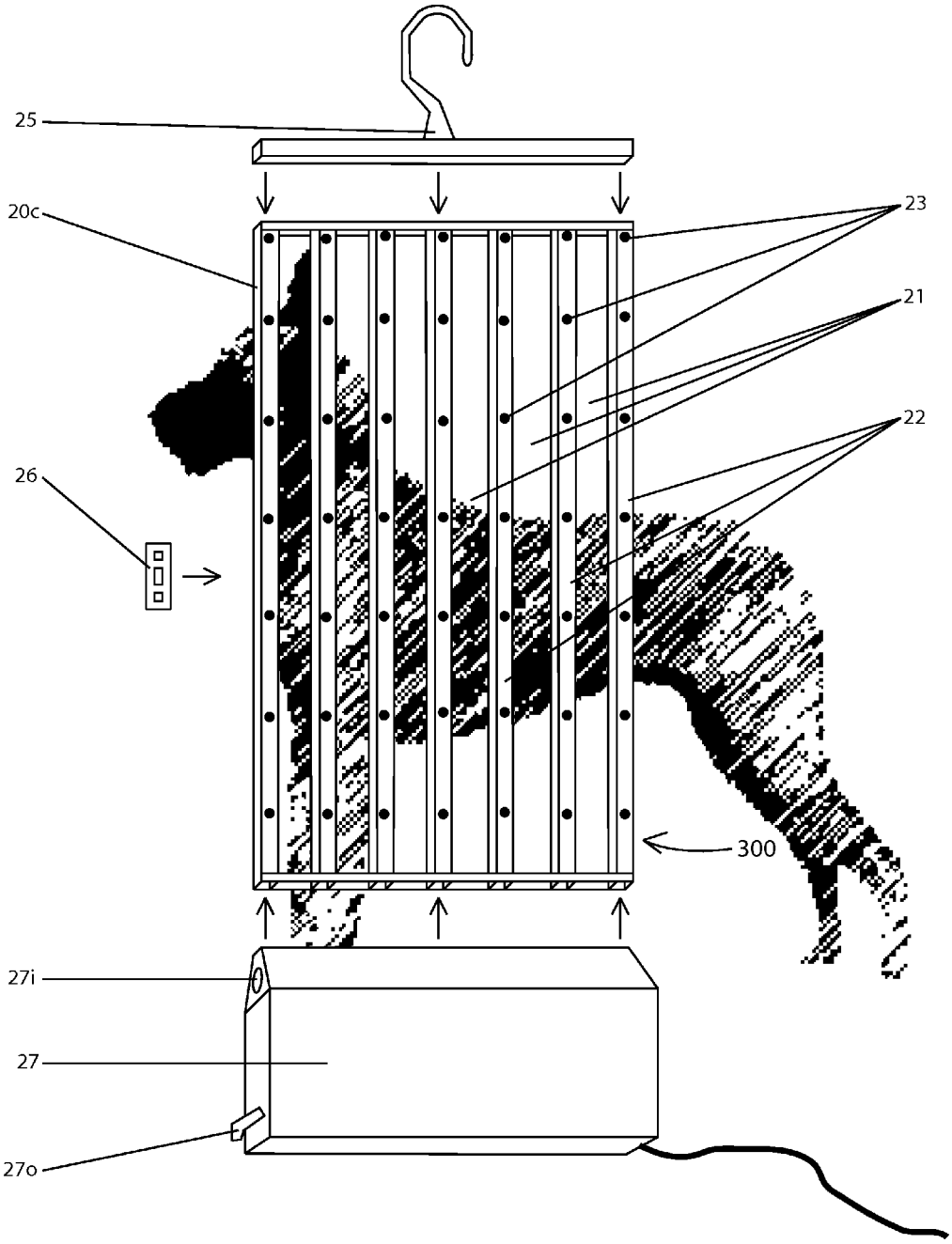
FIG. 6 is an exploded perspective view of the embodiment of my steaming device shown in FIG. 5.

FIGS. 5 and 6

FIGS. 5 and 6 depict an opened wall panel 20*c*. In this panel 20*c* the passageways 22 are elongated, parallel, tubular structures that extend from a crossbar 25*a* of the hanger member 25. This provides openings or spaces 21 between the passageways 22. These open spaces 21 enable steam to flow from one side of the panel to an opposed side of the panel. This may or may not be advantageous depending on the circumstances.

Figure 7:
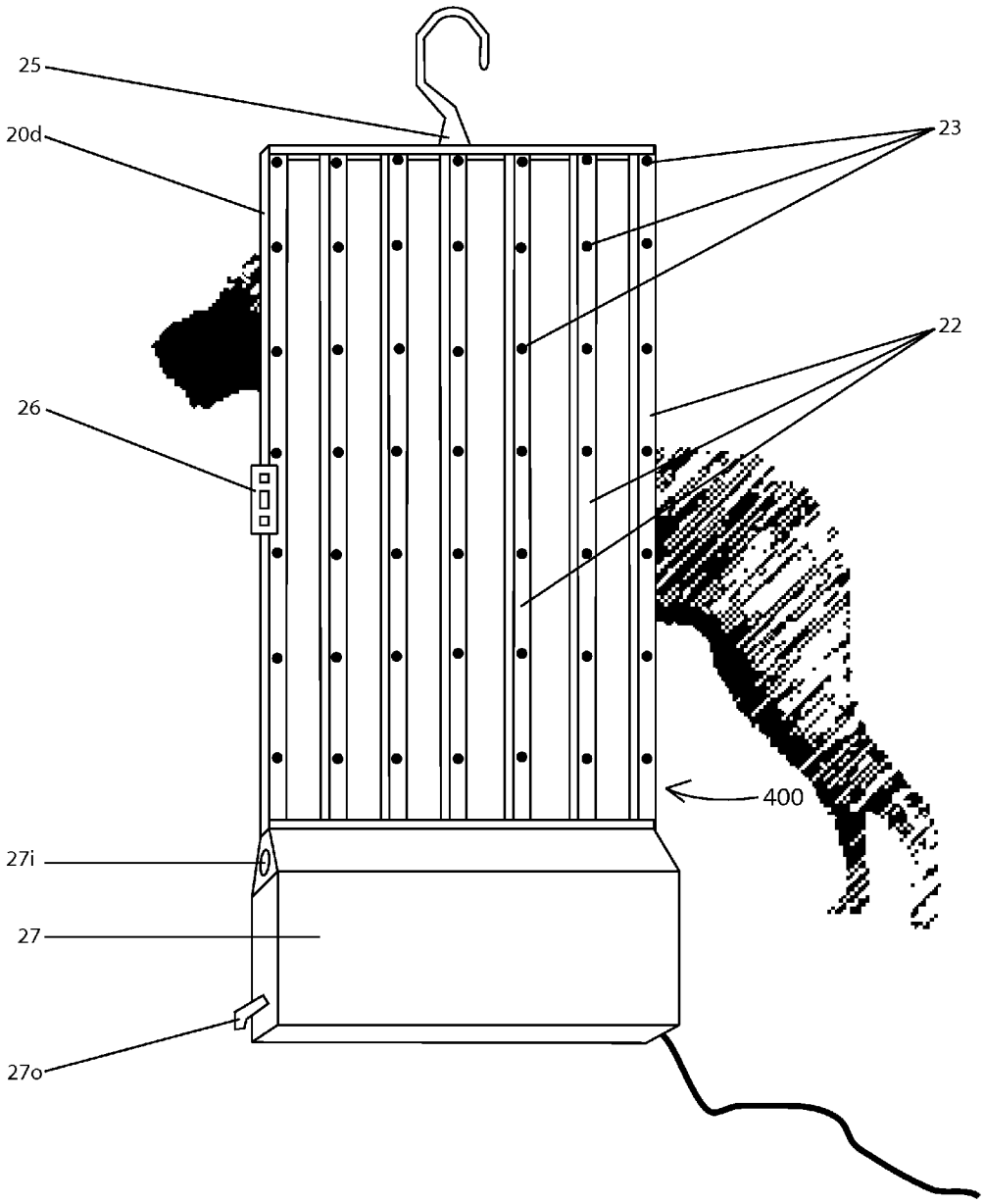
FIG. 7 is a perspective view of a forth embodiment of my steaming device.
Figure 8:
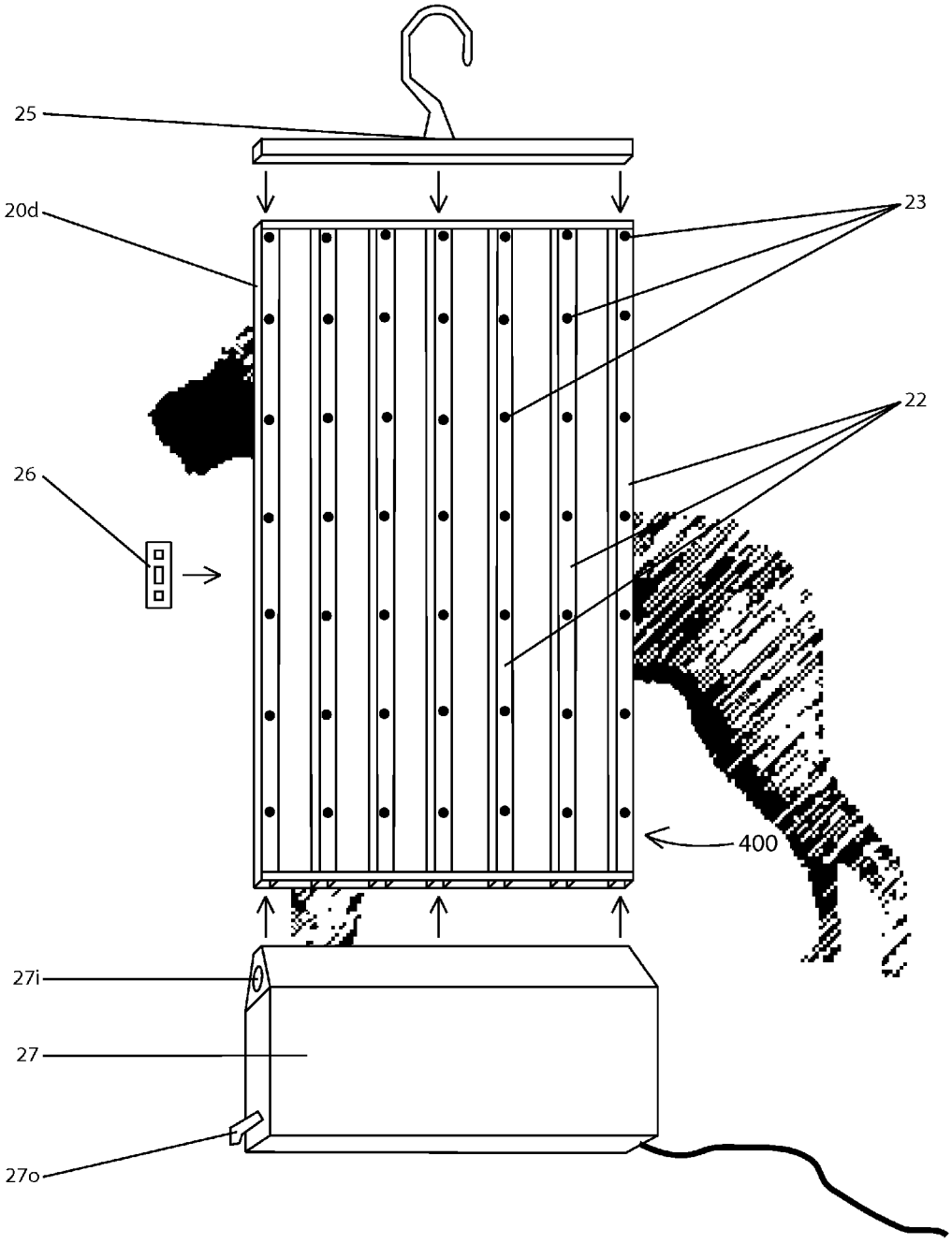
FIG. 8 is an exploded perspective view of the embodiment of my steaming device shown in FIG. 7.

FIGS. 7 and 8

FIGS. 7 and 8 depict a closed wall panel 20*d*. This embodiment is like that shown in FIGS. 5 and 6, except the open spaces 21 are blocked by solid walls SW. This closed wall embodiment is designed to prevent or minimize steam from flowing from one side of the panel 20*d* to an opposed side of the panel side.

Figure 9:
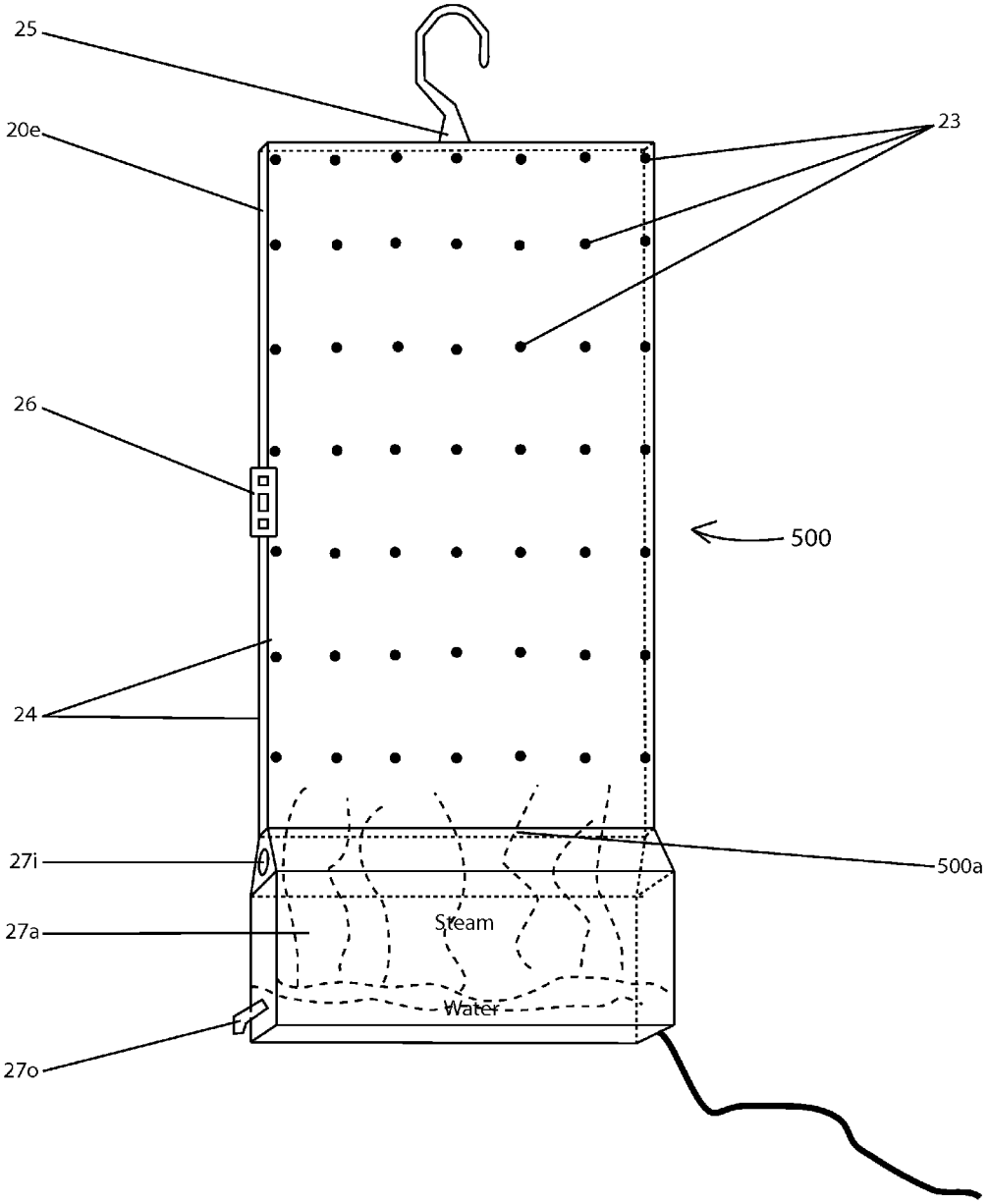
FIG. 9 is a perspective view of a fifth embodiment of my steaming device.
Figure 10:
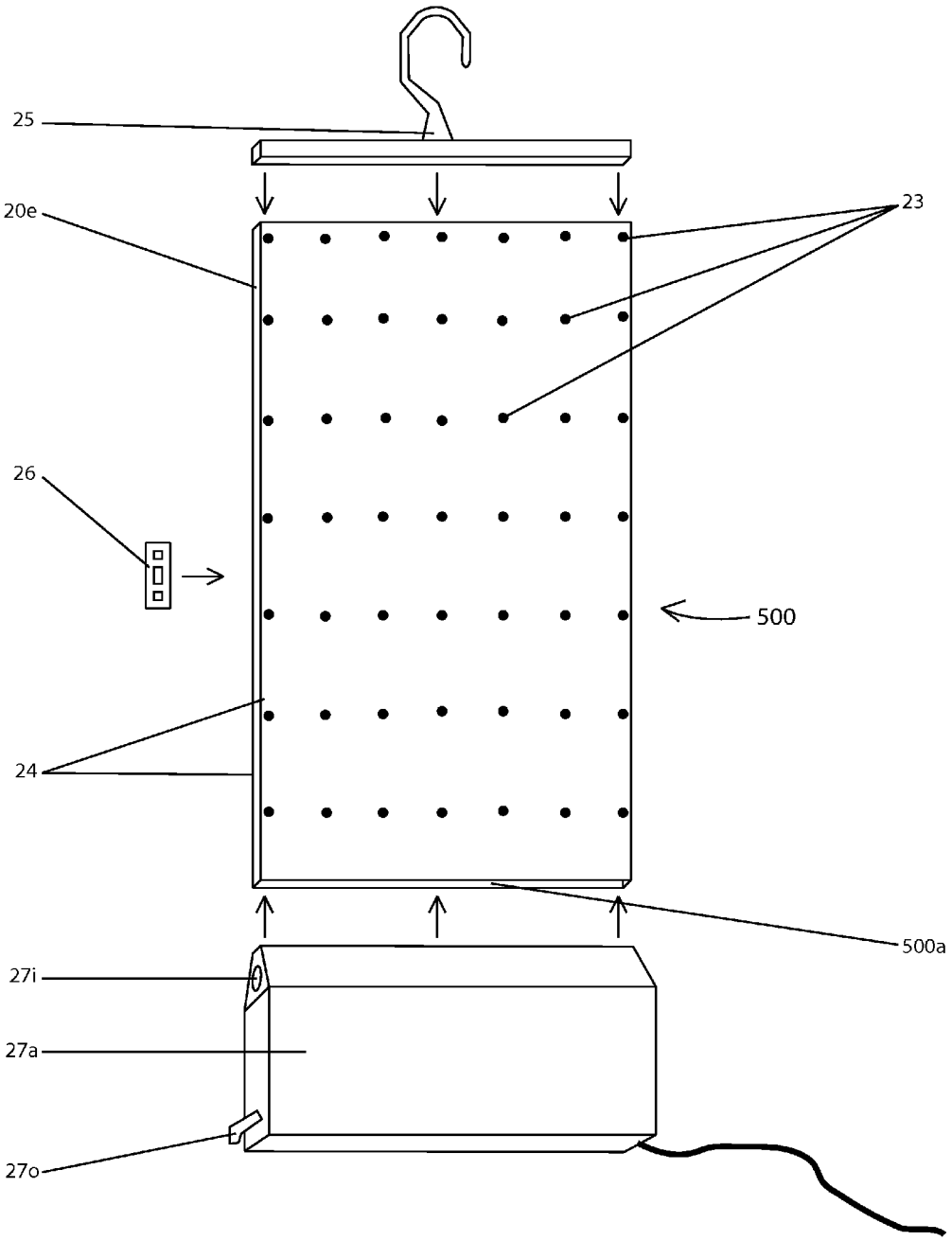
FIG. 10 is an exploded perspective view of the embodiment of my steaming device shown in FIG. 9.

FIGS. 9 and 10

The steaming device 500 illustrated in FIGS. 9 and 10 does not use parallel passageways 22 to form a steam chamber within its panel 20*e*. Rather within the panel 20*e* is a single steam chamber SC corresponding substantially in volume to the entire volume of the panel. There is a single entryway 500*a* to the steam chamber SC in the panel 20*e* along the line of connection between the panel 20*e* and the steam generator 27*a*. This avoids the need for the funnel structures 23*a* (FIG. 1) used with the passageways 22. The panel may be substantially rectangular and has a length substantially from 24 to 60 inches, a width substantially from 12 to 36 inches, and the depth substantially from ⅛ to ½ inches. Thus the volume of the steam chamber SC is substantially from 36 to 1080 cubic inches. The side S1 has uniformly distributed orifices 23 therein from which steam jets shoot. An opposed second side of the panel 20*e* may or may not have such uniformly distributed orifices 23 therein.

FIG. 10A

Figure 10A:
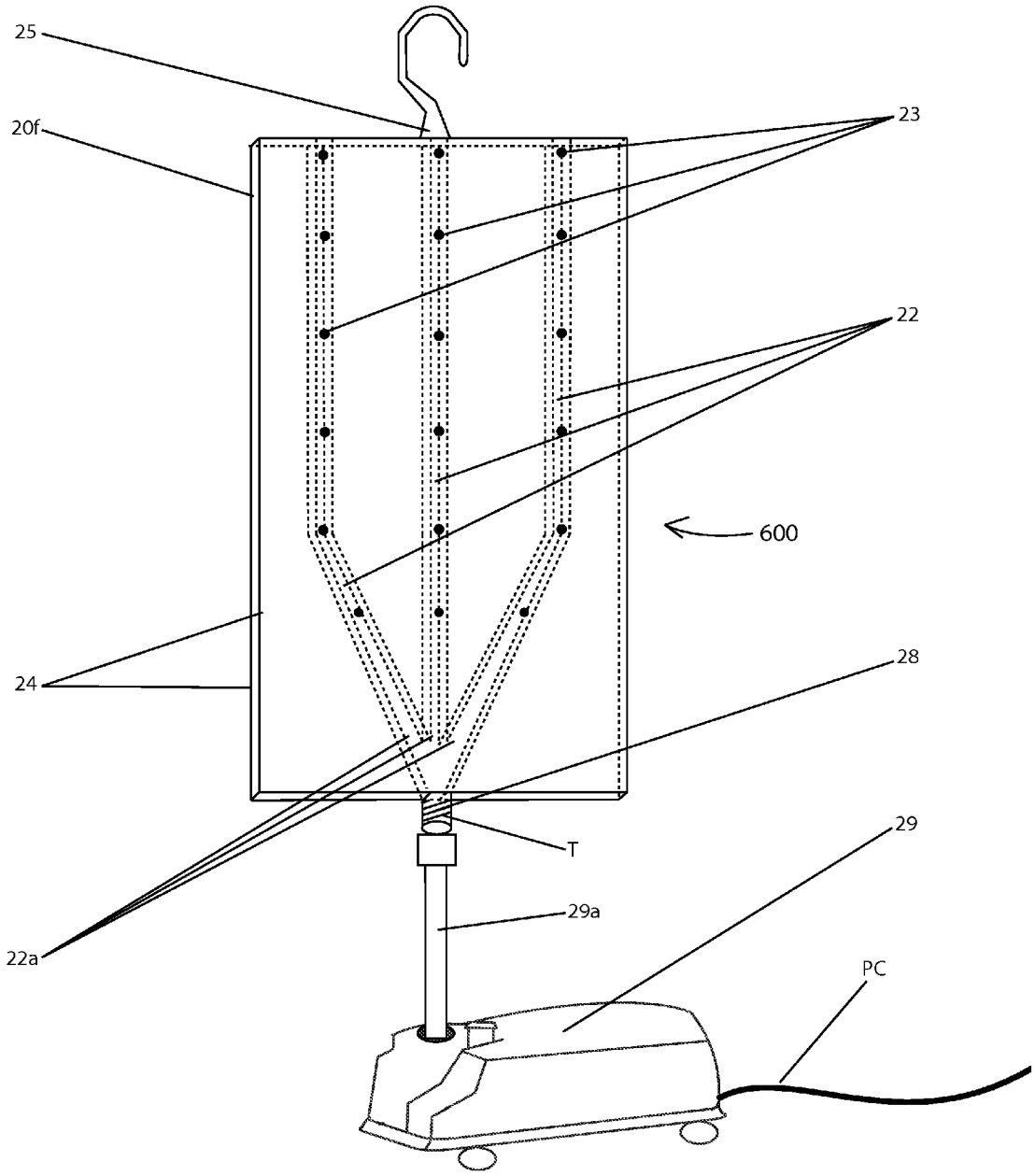
FIG. 10A is a perspective view of a sixth embodiment of my steaming device.

FIG. 10A depicts my steaming device 600 where the passageways 22 at their ends 22*a* converge near the opposite end E2 of the panel 20*f* to form a single port 28 for connection to a steam generator 29 by the hose 29*a* of the generator. In this embodiment, the steam generator is a portable unit that is separate from the panel 20*f*, yet upon connection to the panel directs steam into a lower end of each passageway 22.

FIG. 10B

Figure 10B:
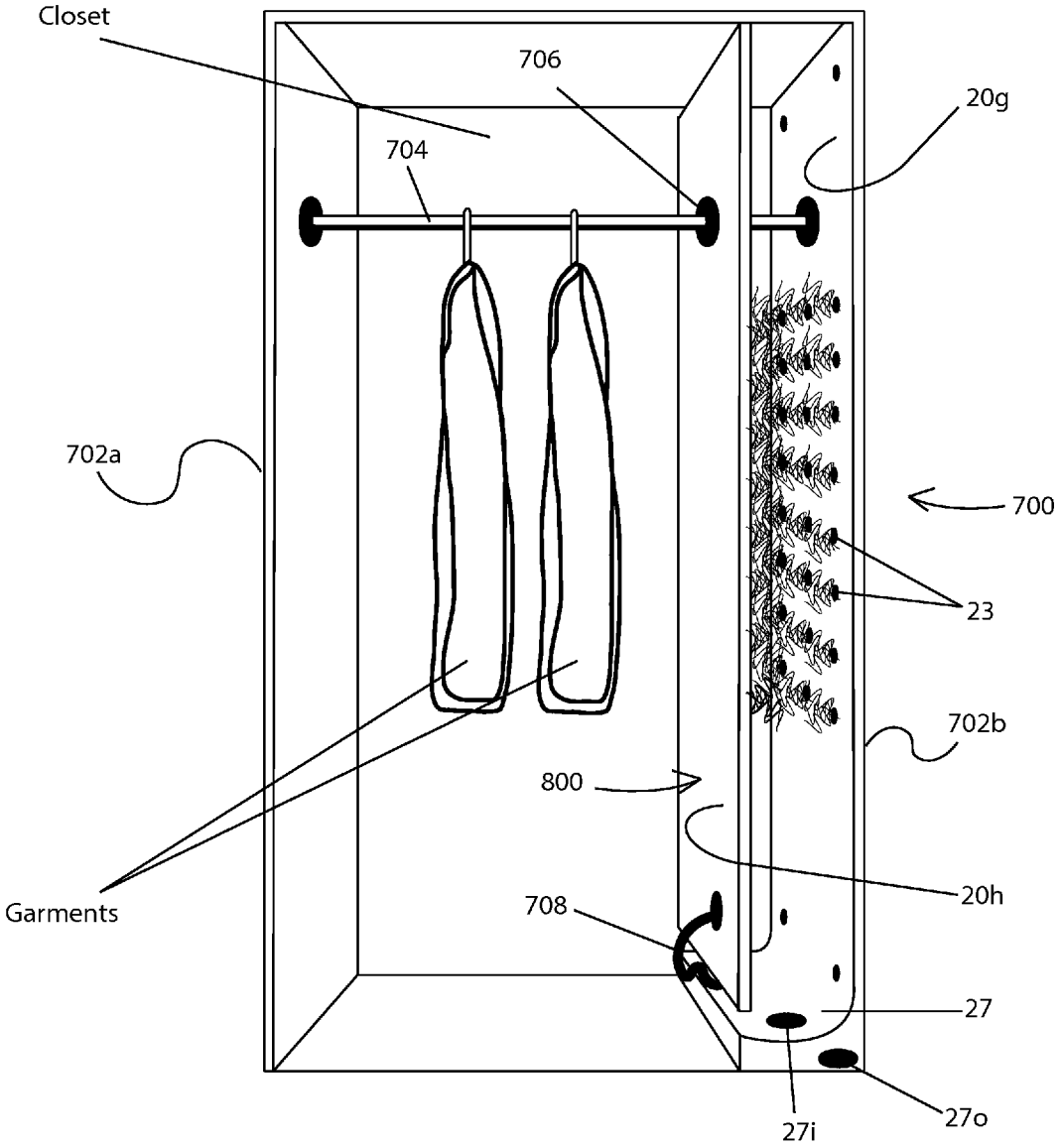
FIG. 10B is a perspective view of a seventh embodiment of my steaming device.

FIG. 10B illustrates my steaming device 700 that is fastened, for example by screws, to an internal surface of an existing vertical sidewall 702*b* of a closet. The closet is shown with its door removed. The closet door may or may not be opened; however, it might be of benefit to leave the door open during steaming so the steam could escape more easily after it bounces of the garment being steamed. My steaming device 700 includes a steaming panel 20*g* with steam jets shooting from orifices 23 in the one side of the panel that faces inward towards the interior of the closet. A removable horizontal pole 704 extends between the closet walls 702*a* and 702*b* and supports vertically hanging garments to be steam treated. Initially, one garment may be moved near the jets being propelled from the panel 20*g*. The one garment may then be repositioned when its one side is treated to treat the garment's opposed side. Alternately, a second steam panel 20*h* with steam jets shooting from its side facing the panel 20*g* may be mounted on the pole 704. This panel 20*h* would simply have an opening 706 in an upper portion of the panel 20*h*, allowing the pole 704 to pass through it when being mounted thereon. The panel 20*h* may move laterally along the pole, and includes a hose 708 that is detachably connected to the steam generator 27 in my device 700. A garment may then be placed between the two panels 20*g* and 20*h*, and both its opposed sides steamed treated simultaneously.

FIGS. 11 through 13

FIGS. 11 through 13 illustrate my method of treating a garment with steam using my steaming device discussed above. The garment to be treated is suspended vertically by a hanger on a horizontal pole 50, for example in a closet. Hanging the garment in a vertical orientation exposes at least one entire side of the garment. This one side of the garment has a predetermined area, typically substantially from 600 to 2000 square inches. The area of the side S1 of the panel 20 is at least as great as this predetermined area of the one side of the garment, typically a maximum of 2200 square inches. In other words, the surface area of the steam panel is essentially the same as or greater than the predetermined area of the one entire side of the garment being treated.

My steaming device is placed adjacent the hanging garment by hanging my device on the same pole 50 carrying the garment. The steam panel 20 with its steam emitting side S1 is positioned close the side of the garment being treated to direct steam from the orifices 23 towards the garment. The panel 20 is so positioned to cover the entire one side of the garment if laid on top of the garment if the garment was spread out and lying on a horizontal surface. The distance between the garment and the steam panel is less than approximately 18 inches. Consequently, essentially the one entire side of the garment is treated simultaneously as steam impinges against the entire predetermined area of this one side of the garment.

General

The different embodiments of my steaming device and method discussed above are not necessarily equivalent. Nevertheless, there are certain common characteristics. For example, the panels used in the different embodiments may be of any suitable material that is heat and steam resistant, for example, it may be formed using conventional processes from a plastic such as, for example, polytetrafluoroethylene (PTFE). The steam passageways 22 are essentially airtight where the steam from the steam generator 27 enters at the terminal ends TE. Steam pressure build ups within the passageways 22 and steam exits through the small diameter orifices 23 as jets. The steam passageways 22 are oriented in a vertical direction when my steaming device is hung by the hanger member 25 in a conventional manner. This allows any condensed water from the steam collecting in a passageway 22 to drain back into the reservoir 27*a*. The orifices 23 are of appropriate size to allow restricted flow of steam, so that the steam will build up pressure inside the steam passageways (as in a tea kettle) and shoot steam out substantially evenly or uniformly at an adjacent garment or garments.

When the panel is positioned at an appropriate distance from an exterior of a garment, typically substantially from 1 to 12 inches, it may then be used to remove wrinkles from that garment. In all the embodiments the steam escaping from the steam generator flows in an upward direction. My method is a more automated process than using the hand held steamers on the market today. My steaming device is compact and fits inside a clothing closet with ease, and may be designed in such a way for easy disassembly. This allows for convenient use in travel. To minimize water mess, the steam passageways are in a vertical direction to allow any condensed water from the steam to drain back into the water reservoir of the steam generator. Since the steam evaporates in an upward direction the same as the hand held steamers do, my steaming device may be constructed in such a way that one panel of one unit would plug into another panel of another unit, for example, as shown on FIG. 10B. Consequently, a user would be able to plug together as many devices as desired to steam more than one side of and/or number of garments concurrently. When plugged into each other my devices may be capable of being controlled by one master on/off/timer switch. They may also be designed to be reversible so that the same device could steam both the left and right side of a garment. My steaming device increases productivity due to the fact that the user would gain most of the time he/she would otherwise lose ironing or steaming with a hand held steamer. Moreover, my steaming device while in use may be left unattended by the user.

Some options that can be used in relation to the garment(s) to be steamed:

1—Designed with the capability to fasten to an ordinary clothes hanger

2—Designed with a "built-in" hanger system

3—Mount to nearby wall with adjustable horizontal positioning wall mount

4—Place on floor with base and wheels

5—Hang using a ceiling fan technique adjustable horizontal positioning wall mount 6—Design a stand built specifically for the panel and garment(s) to be steamed

SCOPE OF THE INVENTION

The above presents a description of the best mode I contemplate of carrying out my steaming device and steaming method and of the manner and process of making and using them, in such full, clear, concise, and exact terms as to enable a person skilled in the art to make and use. My steaming device and steaming method are, however, susceptible to modifications and alternate constructions from the illustrative embodiments discussed above which are fully equivalent. Consequently, it is not the intention to limit my steaming device and steaming method to the particular embodiments disclosed. On the contrary, my intention is to cover all modifications and alternate constructions coming within the spirit and scope of my steaming device and steaming method as generally expressed by the following claims, which particularly point out and distinctly claim the subject matter of my invention:

The invention claimed is:

1. A steaming device comprising a planar steam panel having first and second opposed ends and opposed panel walls with a plurality of orifices distributed over at least one panel wall, a steam compartment within the panel, a steam generator configured to be attached to the panel at the second end, and a hanger member attached to the first end and configured to hang the steaming device in a vertical orientation, so that with the device in the vertical orientation said steam generator is below the panel, said panel including a plurality of parallel hollow steam passageways within the steam compartment, with said one panel wall forming a portion of the passageways, said steam passageways extending lengthwise between the first and second opposed ends and individual passageways terminating at open terminal ends at said second end of the panel, at least some of said orifices spaced apart along the passageways, and said steam generator including a partition member having a plurality of funnel structures, said funnel structures directing steam from within the steam generator to flow under pressure through the funnel structures and into individual open terminal ends of individual passageways, with the steaming device in a vertical orientation, the steam flowing along the passageways and being propelled from the passageways through the orifices as a jet to form a wall of steam that engulfs a garment adjacent said one panel wall of the panel.

* * * * *